US008365504B2

(12) United States Patent
Tampieri et al.

(10) Patent No.: US 8,365,504 B2
(45) Date of Patent: Feb. 5, 2013

(54) METHOD FOR PACKING ARTICLES, IN PARTICULAR PHARMACEUTICAL ARTICLES

(75) Inventors: Pierluigi Tampieri, Imola (IT); Agostino Consolini, Ozzano Emilia (IT)

(73) Assignee: IMA SAFE S.r.l., Ozzano Emilia (Bologna) (IT)

( * ) Notice: Subject to any disclaimer, the term of this patent is extended or adjusted under 35 U.S.C. 154(b) by 0 days.

(21) Appl. No.: 12/673,521

(22) PCT Filed: Sep. 12, 2008

(86) PCT No.: PCT/EP2008/062150

§ 371 (c)(1),
(2), (4) Date: Feb. 15, 2010

(87) PCT Pub. No.: WO2009/040261

PCT Pub. Date: Apr. 2, 2009

(65) Prior Publication Data

US 2011/0126495 A1 Jun. 2, 2011

(30) Foreign Application Priority Data

Sep. 26, 2007 (EP) ..... 07425593

(51) Int. Cl.
*B65B 35/50* (2006.01)

(52) U.S. Cl. ..... 53/447; 53/453; 53/471; 53/474

(58) Field of Classification Search ..... 53/411, 53/415, 447, 453, 467, 468, 471, 474, 475, 53/492

See application file for complete search history.

(56) References Cited

U.S. PATENT DOCUMENTS

| | | | | |
|---|---|---|---|---|
| 2,916,859 | A * | 12/1959 | Klein | 53/428 |
| 3,392,501 | A * | 7/1968 | Gilchrist, Jr. | 53/411 |
| 4,059,264 | A * | 11/1977 | Vogel | 271/270 |
| 4,462,851 | A * | 7/1984 | Colgate, Jr. | 53/411 |
| 4,620,891 | A * | 11/1986 | Applegate et al. | 156/212 |
| 4,843,801 | A * | 7/1989 | Roncero | 53/492 |
| 5,081,816 | A * | 1/1992 | Cardinali | 53/54 |
| 5,469,692 | A * | 11/1995 | Xanthopoulos | 53/474 |
| 5,896,728 | A * | 4/1999 | Domino et al. | 53/458 |
| 6,877,609 | B2 * | 4/2005 | Barker et al. | 206/722 |

(Continued)

FOREIGN PATENT DOCUMENTS

| | | | |
|---|---|---|---|
| DE | 10341451 | A1 | 3/2005 |
| EP | 0465437 | A | 1/1992 |
| FR | 2810974 | A | 1/2002 |
| WO | W02005/108209 | A | 11/2005 |
| WO | WO2006/055515 | A | 5/2006 |

OTHER PUBLICATIONS

International Search Report.

*Primary Examiner* — M. Alexandra Elve
*Assistant Examiner* — Eyamindae Jallow
(74) *Attorney, Agent, or Firm* — William J. Sapone

(57) ABSTRACT

A method for packing articles, in particular articles, comprising stages of production of a succession of blister packs containing the articles, packing resulting groups of blister packs in cartons, and storing the cartons in at least a warehouse unit, the method being characterized in that it includes transferring the cartons to at least a second warehouse unit, opening the cartons and extracting the groups of blister pack in order to enable performing of an inserting of information on each group f blister packs or on each blister pack, and packing the blister packs, provided with the information, in box containers.

6 Claims, 3 Drawing Sheets

U.S. PATENT DOCUMENTS 6,878,222 B1 * 4/2005 Os ..... 156/64
7,437,860 B2 * 10/2008 Brandow et al. ..... 53/135.1
7,858,131 B2 * 12/2010 Billmann et al. ..... 426/383
2004/0131736 A1 * 7/2004 Pan et al. ..... 426/419

* cited by examiner

METHOD FOR PACKING ARTICLES, IN PARTICULAR PHARMACEUTICAL ARTICLES

TECHNICAL FIELD

The invention relates to a method for packing articles, in particular pharmaceutical articles.

BACKGROUND ART

In general, a known apparatus for packing articles, for example pharmaceutical articles or the like, in packs known as blister packs, in turn destined to be subsequently inserted and arranged piled in groups internally of relative containers, such as for example boxes or cartons, overall comprises, according to what is schematically illustrated in appended FIG. 1, a unit 100 for blister pack production, coupled to a unit 101 for packing in cartons.

The blister pack unit 100 in turn comprises at least an unwinding station 50 of a first strip 1 in which cells 2 are subsequently formed, a supply station 3 of articles P which are to be housed in the cells 2, a control station 4 of the presence and condition of the articles P, an unwinding station 51 of a second strip 5 which will be used to seal the first celled strip 1 with the cells 2 filled with the articles P, followed by a cutting station 8 in which formation of single blister packs B is performed, the blister packs B having been obtained by means of sequential cutting of the celled strip 1.

Between the unwinding station 51 and the cutting station 8 there is a printing station 6 in which variable data is printed (or another method) on the celled strip 1 and a further control station 7 of the printed data itself.

In particular, the variable data which is printed on the celled strip 1 in the station 6, and which is therefore visible on each single blister pack B obtained successively from the strip 1, relate for example to a production batch number, and/or the name of the producer of the article P and/or other necessary and important information for the traceability and control of the blister pack B and therefore the relative articles P contained in the blister pack B.

At the packing unit 101 coupled to the blister pack production unit 100, the blister packs B produced by the unit 100 are duly piled to form groups 9 which are then introduced, by pusher means at an insertion station 10, into boxes or cartons 11 together with any further elements or variable data such as for example instructions or information sheets or booklets 12. At a following closing station 13 the cartons 11 are closed and supplied to a further printing station 14, in which variable data or codes are impressed or printed on the cartons 11, which data might for example relate to a production batch number, and/or to a packing date and a respective use-by date for the active ingredient of the article P, or other like data codes.

At present, with the aim of combining the high quality and production standards required for blister packs and their cartons, and in the light of an increasing flexibility of distribution and sale throughout the world, it is advantageous to use a limited number of production plants and warehouses, which are therefore large and often situated in a limited number of industrialized countries, which are able to guarantee very large production batches, and from whose warehouses the quantity of blister pack cartons are sourced, which will then be transported and sent on to the different countries of the world in such quantities as to satisfy, time by time, the demands of the specific markets.

The production and distribution methods however are the cause of certain drawbacks.

A considerably complex management burden is created, in particular with reference to the treatment and control of the variable data to be associated to the blister packs and/or the relative cartons, as this data must necessarily be printed compatibly with the languages used in the respective target countries for distribution and sale.

A similar consideration has to be made for the variable elements such as information sheets, which among other things, as is known, contain not only the instructions for the correct use and dosage, but also and especially provide information on any side-effects of the drug contained in the articles P, and which therefore in order to be perfectly understood must be written in the official language of the specific country in which the drugs are to be put on sale.

Further, the production line of the whole packing apparatus, made up of the blister unit and the cartoning unit, has to be halted and newly set up each time the data or identification codes are to be changed to make them compatible with product destination.

These production halts, as is easily understandable, considerably reduce the efficiency of the production line and thus have a considerable negative economic impact.

The aim of the present invention is to obviate the problems and drawbacks mentioned above.

In particular, the invention intends to overcome the drawbacks by means of a packing methodology which enables a production of blister packs and their subsequent packing in box cartons, with the peculiarity of comprising a first stage in which association of the variable data to the blister packs and/or relative cartons is at least partially left off, thus increasing the production efficiency of the packing and boxing line, and a second stage, following the first stage, realized in a different place, in which the association of the variable data is completed or indeed applied in its entirety.

The above aims are obtained according to the content of the claims.

BRIEF DESCRIPTION OF THE DRAWINGS

The accompanying drawings illustrate embodiments of the present invention, wherein.

DISCLOSURE OF THE INVENTION

A method for packing articles, in particular pharmaceutical articles, comprising stages of production of a succession of blister packs containing the articles, packing resulting groups of the blister packs in cartons, and storing the cartons in at least a warehouse unit, the method being characterized in that it includes transferring the cartons to at least a second warehouse unit, re-opening the cartons and extracting the stacked groups of blister packs in order to enable performing of an inserting of information on each group of blister packs or on each blister pack, and packing the group of blister packs, provided with the information, in box containers.

BEST MODE FOR CARRYING OUT THE INVENTION

Figure 2:
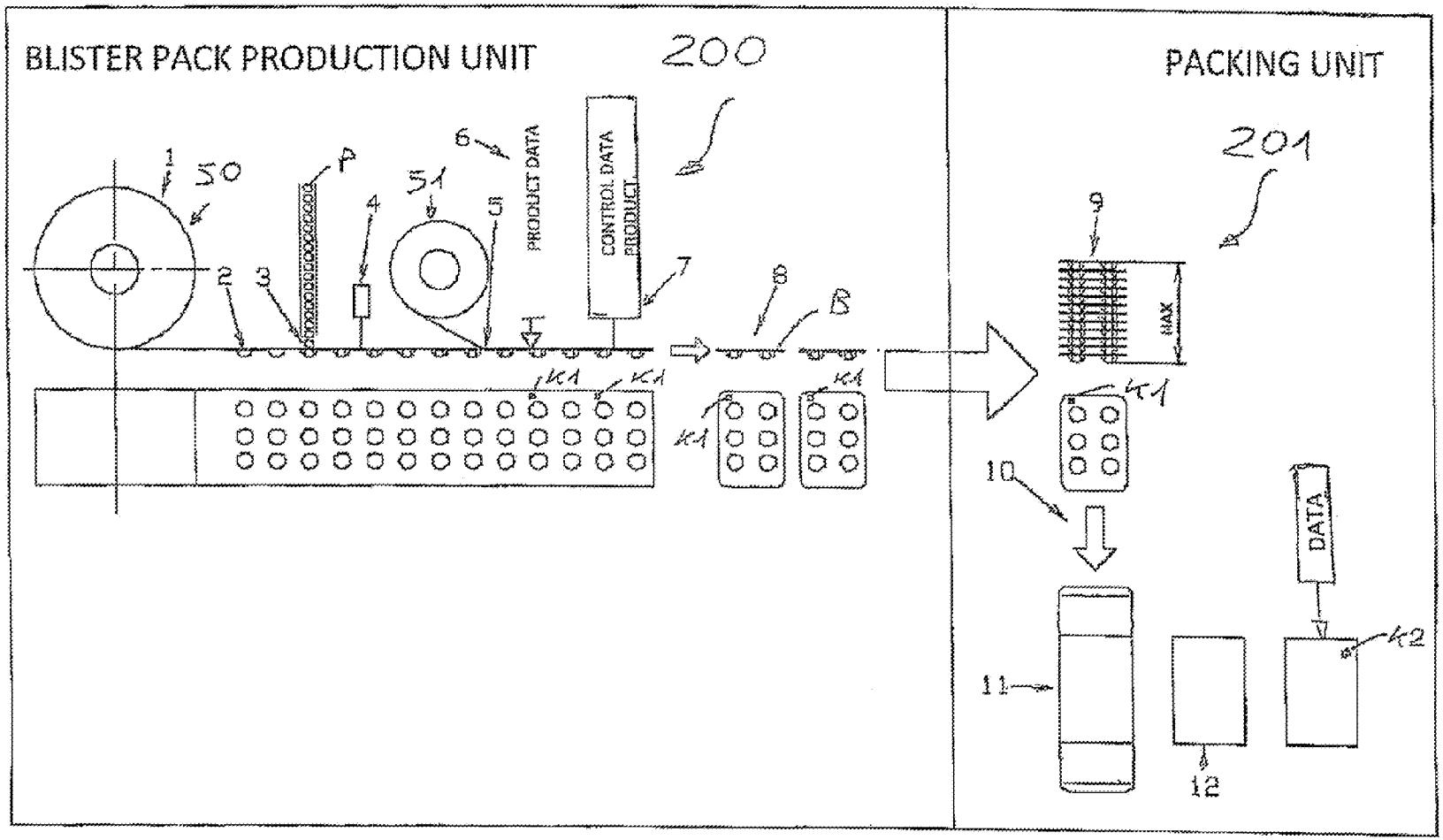
FIG. 2 illustrates a blister pack production unit 200 according to the present invention, coupled to a box-packing unit 201; and, FIG. 3 illustrates a de-boxing unit 202 and a packing unit 203 illustrating a stage of "customizing" in the management of variable data in the apparatus.
Figure 3:
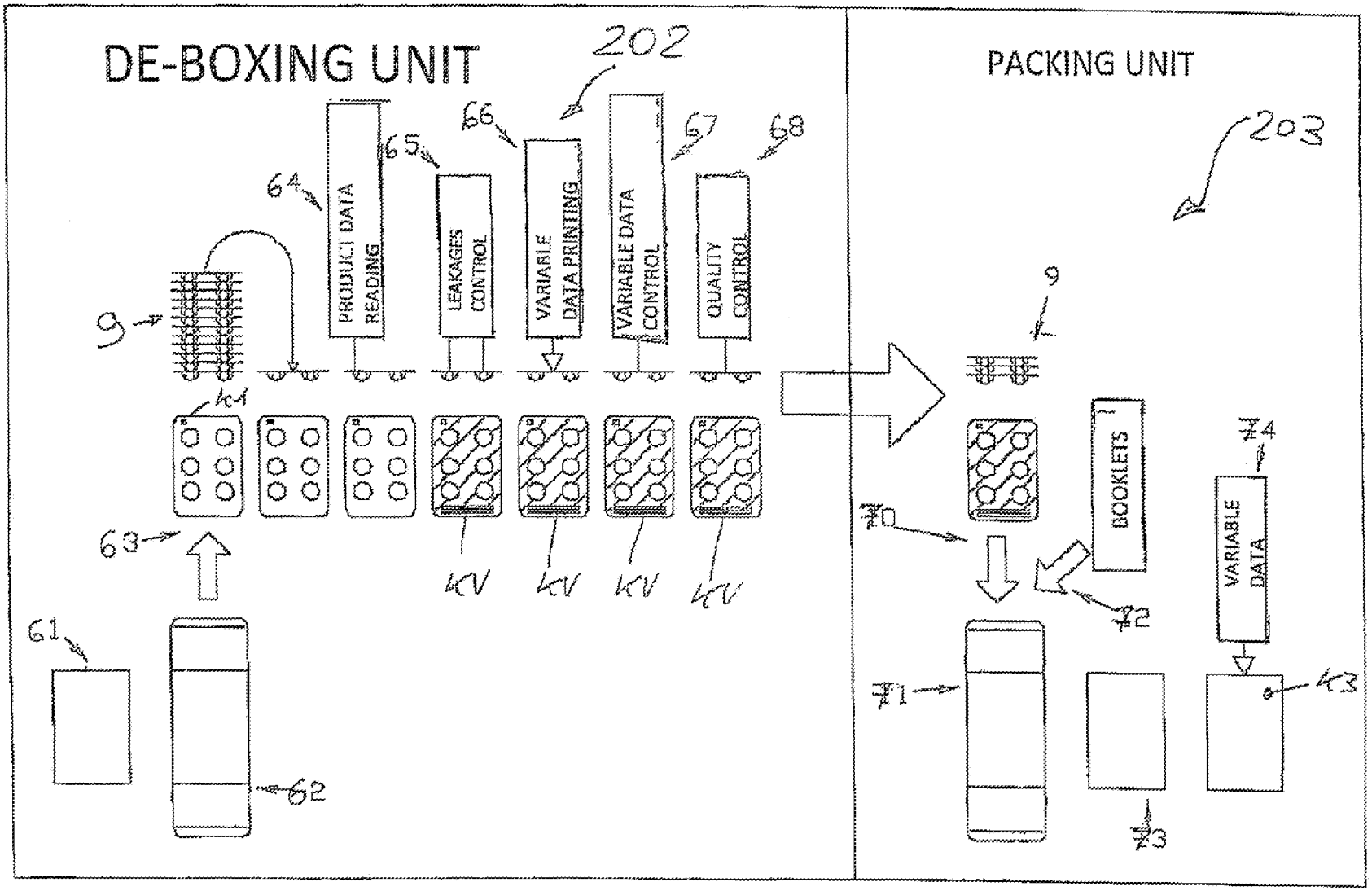

In particular a first embodiment, given by way of non-limiting example, of a packing apparatus for realizing the method of the invention is illustrated in FIGS. 2 and 3 of the appended tables of drawings.

FIG. 2 illustrates a blister pack production unit 200, coupled to a box-packing unit 201.

The blister pack production unit 200 in turn comprises an unwinding station 50 of a first strip 1 in which cells 2 are subsequently formed, an article P supply station 3 for articles P which will be housed in the cells 2, a control station 4 of the presence and condition of the articles P, an unwinding station 51 of a second strip 5 which will be used to close the first celled strip 1 by sealing, the cells 2 having been filled with the products P, followed by a cutting station 8 in which formation of the single blister packs B is done by sequential cutting of the celled strip 1.

Between the unwinding station 51 and the cutting station 8 there is a printing station 6 in which codes K1 are printed on the celled strip 1 and a further control station 7 of the printed codes.

In particular, codes K1 printed at the station 6 relate exclusively to recognition of the article P or recognition of the type of drug or active ingredient used.

At the boxing unit 201 coupled to the blister unit 200 the blister packs B produced by the unit 200 are duly piled to form groups 9 which are then introduced into cartons 11, by special pusher means at an insertion station 10. At a subsequent closing station 12 the cartons 11 are closed and sent on to a further printing station 13, in which codes K2 are impressed on the cartons 11 so that they will be accurately recognizable.

The blister packs and the cartons thus obtained can then be stored using conventional techniques for storing, in warehouses, from which they are transferred to other warehouses, located for example in different places from the production site, meaning from the factories in which the units 200 and 201 are located.

Storage can be optimized by using maximum-height cartons such as to be able to introduce piles of blister packs formed by a greatest possible number of single packs.

Turning to FIG. 3, a "de-boxing" unit 202 is illustrated, specially predisposed to realize the present invention. The unit 202 is supplied with the cartons 11 produced and realized by the packing apparatus schematically illustrated in FIG. 2.

The unit 202 comprises the following operating stations: an opening station 62 in which the cartons 11 are automatically opened; an extraction station 63 at which a piled group 9 of blister packs B is removed in sequence from each open carton 11; a control station 64, in which a reading or detection of the codes K1 printed on the blister packs B is made; a control station 65 of the seal state of the single blister packs B with detection of any leakage; a printing station 66 of variable data KV on the blister packs B, the variable data KV being, for example, the production batch number, and/or the name of the producer of the article P and/or other data which is necessary and important for the traceability and control of the blister pack B and thus the relative articles P contained therein.

There is also a station 67 for controlling the variable data KV and a quality control station 68.

A relative reject station for defective blister packs B could be included for each of the control stations 65, 67 and 68.

Figure 1:
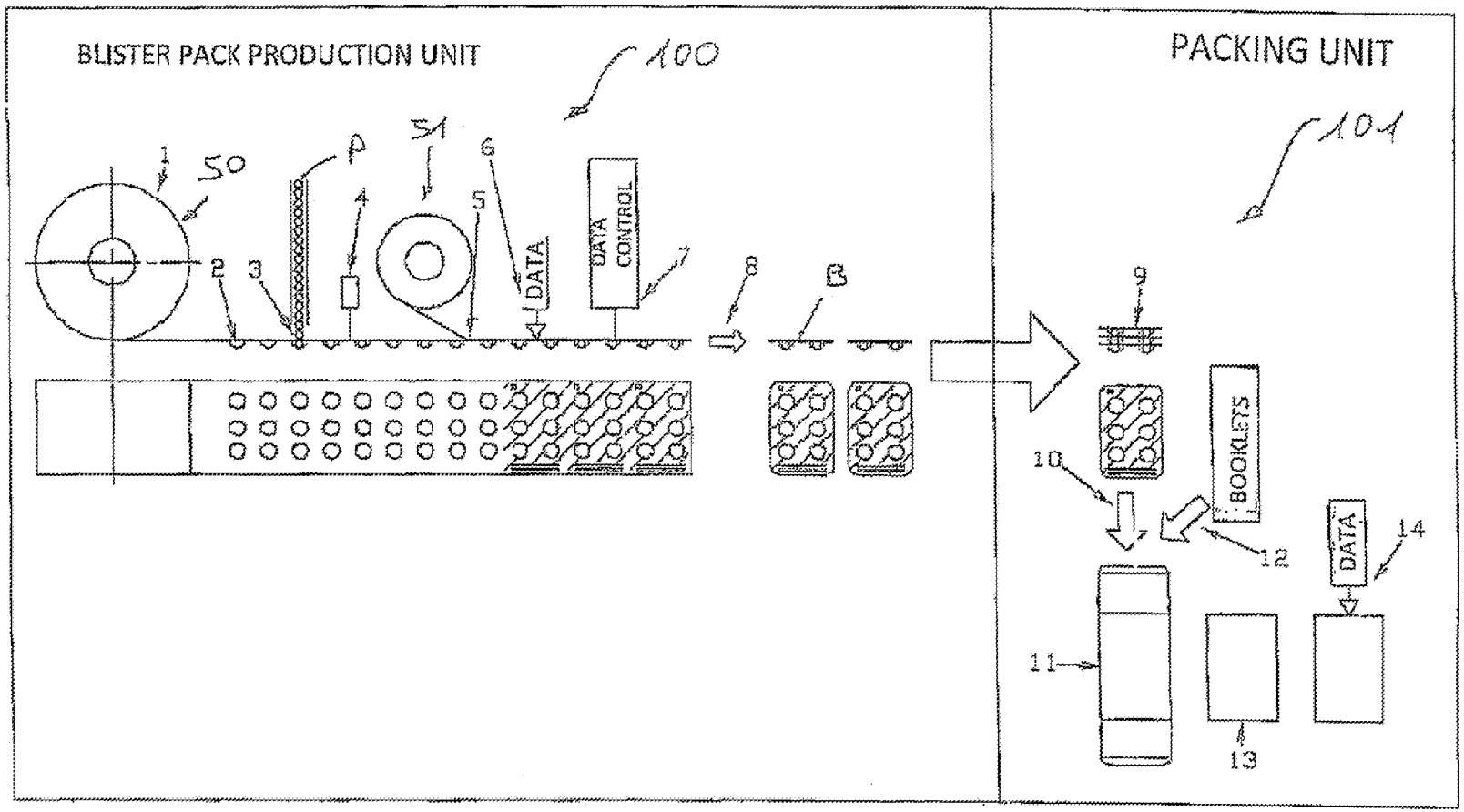
PRIOR ART Fig. 1
FIG. 1 illustrates a prior art unit 100 for blister pack production, coupled to a unit 101 for packing in cartons.

The blister packs B thus processed are then sent to a boxing unit 203 similar or identical to the traditional unit 101 illustrated in FIG. 1, in order to be duly re-piled to form groups 69 which are introduced in an insertion station 70 in relative cartons 71 together with further elements or variable data such as contents information sheets or booklets 72, the cartons then being closed at a closing station 73; a printing station 74 is included for impressing variable data K3, such as for example printed material or stamps and seals relating to a specific country of destination, and/or the production batch number, and/or the packing date and the important use-by date of the drug in the article P, or other like information codes.

The apparatus unit 202 having these functions thus enables processing of the blister packs B, produced and boxed using units 200 and 201 of FIG. 2, by adding the missing variable data whose association to the blister packs B and relative cartons had been withheld, with the exception of codes K1 and K2.

In this way, the method frees the blister pack production line from the complex management of the variable data, thus increasing production efficiency and preventing down-times for setting up the data.

The stage of "customizing" in the management of the variable data is thus devolved on the apparatus illustrated in FIG. 3, which can preferably be installed but not limitedly so in other sites or different warehouses, for example in the final country of destination to which a specific production batch is destined.

Thanks to this organization of the production, the stages in which the blister packs and the cartons are differentiated with specific aspects, especially linguistic aspects, of the country which is the market of destination can be postponed; this solution further enables the different data to be applied in more appropriate sites, such as in the country itself to which the packs are destined.

With the invention, the following advantages are obtained:

the possibility to store the blister packs in standard cartons (boxes, packages) in order to guarantee long storage in warehouses or when shipping; thus preventing the use of "special" cartons which do not guarantee the same level of product protection;

the possibility to store the blister packs without modifying the existing production lines with additional operating groups, which increase both complexity and cost, but which are necessary for inserting the blister packs in "special" containers;

a packing apparatus, fed with boxes or cartons containing, for example, blister packs, sachets or vials, able to automatically open the boxes, extract the packs contained therein, read off any product identifying data, possibly perform controls on the integrity and quality of the product, complete it with insertion of variable data, control the data and be connected to a traditional boxing unit. A relative reject station can be present for each control station.

In practice, the functionalities can be summed up by the following points:

automatic carton storage;

control of correspondence of a code present on the boxes and rejection in case of non-correspondence;

opening of the cartons;

extraction of the piled groups of blister packs;

possible control on effectiveness of blister pack seal;

positioning of single blister packs on a conveyor;

control of correspondence of a code relating to articles contained in a blister pack and possibility of rejection;

printing of data or information sheets, for example in relation to a country of destination, contents, production batch, use-by date, use modalities etc;

control of above-cited printed material and possible rejection;

insertion in final carton containers suitable for final marketing.

The invention claimed is:

1. A method for packing articles, in particular pharmaceutical articles, comprising:

completing stages of production of a succession of blister packs containing the articles, stacking the blister packs in piled groups and packing the resulting piled groups of the blister packs in a plurality of first cartons adapted for storing the piled groups of blister packs, closing the first cartons, and storing the closed first cartons in at least a first warehouse unit, the method further comprising:

transferring the closed first cartons to at least a second warehouse unit, re-opening the first cartons and extracting and removing in sequence, all of the piled groups of blister packs from the opened first cartons and then inserting information on each piled group of blister packs or on each blister pack of an extracted piled group, and then introducing and thereby inserting and packing the piled group of blister packs, provided with the information, into second cartons adapted for final marketing of the blister packs.

2. The method of claim 1, characterized in that the inserting of information comprises application by printing of data or codes on each blister pack.

3. The method of claim 1 wherein the step of inserting of information comprises associating relative information sheets or booklets to the groups of blister packs.

4. The method of claim 1 further comprising, after the step of inserting information, the steps of:

separating individual blister packs from each other;

inspecting each individual blister pack and detecting any defective blister packs;

removing any defective blister packs;

reforming the remaining blister packs into piled groups of blister packs; and, introducing and thereby inserting and packing the reformed piled group of blister packs, provided with the information, into the second cartons adapted for final marketing of the blister packs.

5. A method for packing articles, in particular pharmaceutical articles, comprising:

completing a plurality of operating stages realized in a sequence in a first warehouse unit, among which at least one stage comprises unwinding a first strip of packaging material, a stage of formation on the first strip of a plurality of cells to form a celled strip, a stage of inserting articles in the cells, a stage of sealing the celled strip filled with the articles, a stage of applying on the celled strip at least a code relating to the articles, a stage of cutting the sealed celled strip in order to form a succession of single blister packs, a stage of piling the blister packs to define piled groups of the blister packs, a stage of inserting the piled groups in succession into partially open first cartons adapted for storing the piled group of blister packs and a stage of closing the first cartons;

the method further comprising transferring the closed first cartons to a second warehouse, re-opening the first cartons in succession, extracting and removing in sequence all of the piled groups of the blister packs from the open first cartons, inserting information on each piled group of blister packs or on each blister pack of an extracted piled group, and introducing and thereby inserting and packing the piled groups of blister packs provided with the information into a plurality of second cartons suitable for final marketing of the blister packs.

6. The method of claim 5 further comprising, after the step of inserting information, the steps of:

separating individual blister packs from each other;

inspecting each individual blister pack and detecting any defective blister packs;

removing any defective blister packs;

reforming the remaining blister packs into piled groups of blister packs; and, introducing and thereby inserting and packing the reformed piled group of blister packs, provided with the information, into the plurality of second cartons suitable for final marketing.

* * * * *